US009493933B2

(12) United States Patent
Byron et al.

(10) Patent No.: US 9,493,933 B2
(45) **Date of Patent: *Nov. 15, 2016**

(54) PEDESTAL STRAINER FOR A SINK DRAIN

(71) Applicant: BrassCraft Manufacturing Company, Novi, MI (US)

(72) Inventors: David J. Byron, Southfield, MI (US); Joseph Schutte, Ann Arbor, MI (US)

(73) Assignee: BrassCraft Manufacturing Company, Novi, MI (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/614,514

(22) Filed: Feb. 5, 2015

(65) Prior Publication Data

US 2016/0040408 A1 Feb. 11, 2016

Related U.S. Application Data

(60) Provisional application No. 62/034,335, filed on Aug. 7, 2014.

(51) Int. Cl.

| | |
|---|---|
| ***E03C 1/264*** | (2006.01) |
| ***E03C 1/04*** | (2006.01) |
| ***E03C 1/18*** | (2006.01) |
| ***E03C 1/26*** | (2006.01) |
| ***B05B 1/06*** | (2006.01) |
| ***B05B 1/12*** | (2006.01) |
| ***B05B 1/16*** | (2006.01) |
| ***B05B 1/30*** | (2006.01) |
| ***B05B 12/00*** | (2006.01) |

(52) U.S. Cl.

CPC ..... *E03C 1/0405* (2013.01); *B05B 1/06* (2013.01); *B05B 1/12* (2013.01); *B05B 1/1618* (2013.01); *B05B 1/1663* (2013.01); *B05B 1/3046* (2013.01); *B05B 12/002* (2013.01); *E03C 1/18* (2013.01); *E03C 1/26* (2013.01); *E03C 1/264* (2013.01)

(58) Field of Classification Search

CPC ..... E03C 1/264
USPC ..... 4/619–660
See application file for complete search history.

(56) References Cited

U.S. PATENT DOCUMENTS

| | | | |
|---|---|---|---|
| 1,195,827 | A | 8/1916 | Lucke |
| 1,494,882 | A | 5/1924 | Barger |
| 1,618,679 | A | 2/1927 | Schifter |
| 1,746,683 | A | 2/1930 | Schifter |
| 3,982,289 | A | 9/1976 | Robbins |
| 4,134,162 | A | 1/1979 | Sharland et al. |
| 4,170,047 | A | 10/1979 | Corsette et al. |
| 6,588,029 | B2 | 7/2003 | Mullings |
| 7,736,499 | B2 | 6/2010 | Chong et al. |
| 8,539,618 | B2 | 9/2013 | Gibson et al. |
| D691,245 | S | 10/2013 | Ho |

*Primary Examiner* — Lori Baker
(74) *Attorney, Agent, or Firm* — Reising Ethington P.C.

(57) ABSTRACT

A sink drain pedestal strainer with a central longitudinal axis includes a pedestal extending upwardly away from a base. The pedestal includes a perforate sidewall to facilitate flow of water toward the inner periphery of the base, and a perforate upper wall extending radially inwardly from the sidewall.

20 Claims, 4 Drawing Sheets

PEDESTAL STRAINER FOR A SINK DRAIN

CROSS-REFERENCE TO RELATED APPLICATION

This application claims the benefit of U.S. Provisional Application No. 62/034,335, filed Aug. 7, 2014. The content of the above application is incorporated herein by reference in its entirety.

TECHNICAL FIELD

This disclosure relates generally to strainers for sink drains.

BACKGROUND

A typical drain for a kitchen sink usually includes a strainer housing carried in a drain hole in a bottom of the sink, and a strainer basket removably carried in the strainer housing. The strainer housing typically includes a circular flange supported around the drain hole on an upper surface of the sink bottom, and a cylindrical cup depending downwardly from the flange through the drain hole. When a pan is placed in the sink, it may cover the drain entirely and thereby create a seal with the sink bottom around the drain, such that running water backs up in the sink and does not flow down the drain. Also, the strainer basket is easily clogged with debris, thereby causing water to back up in the sink.

BRIEF SUMMARY

An illustrative embodiment of a sink drain pedestal strainer with a central longitudinal axis includes an annular base, and a pedestal extending upwardly away from the base. The pedestal includes a perforate sidewall to facilitate flow of water toward the inner periphery of the base, and a perforate upper wall extending radially inwardly from the sidewall.

DETAILED DESCRIPTION

Figure 1:
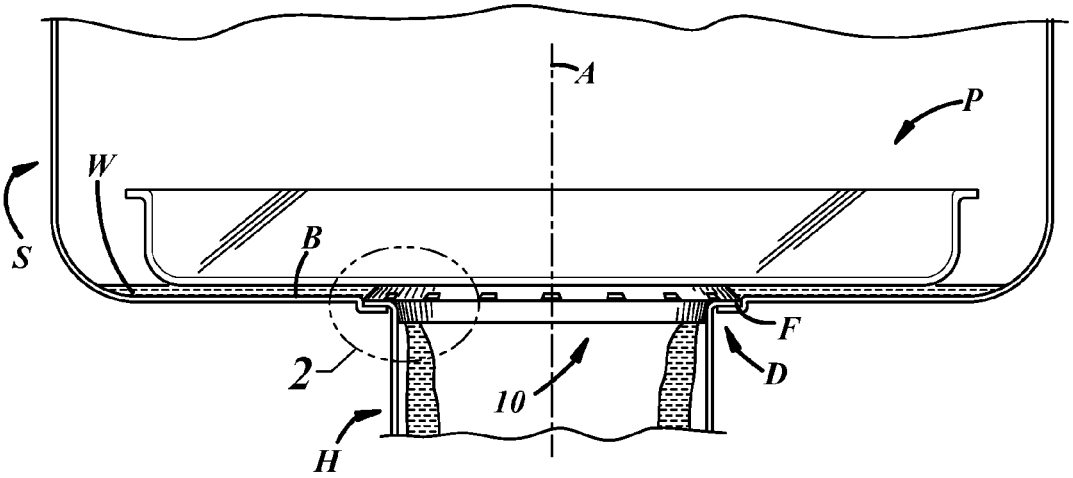
FIG. 1 is a fragmentary, schematic view according to an illustrative embodiment of a pedestal strainer, which is shown carried by a sink drain, supporting a large glass dish thereon, but allowing water to flow therethrough.
Figure 2:
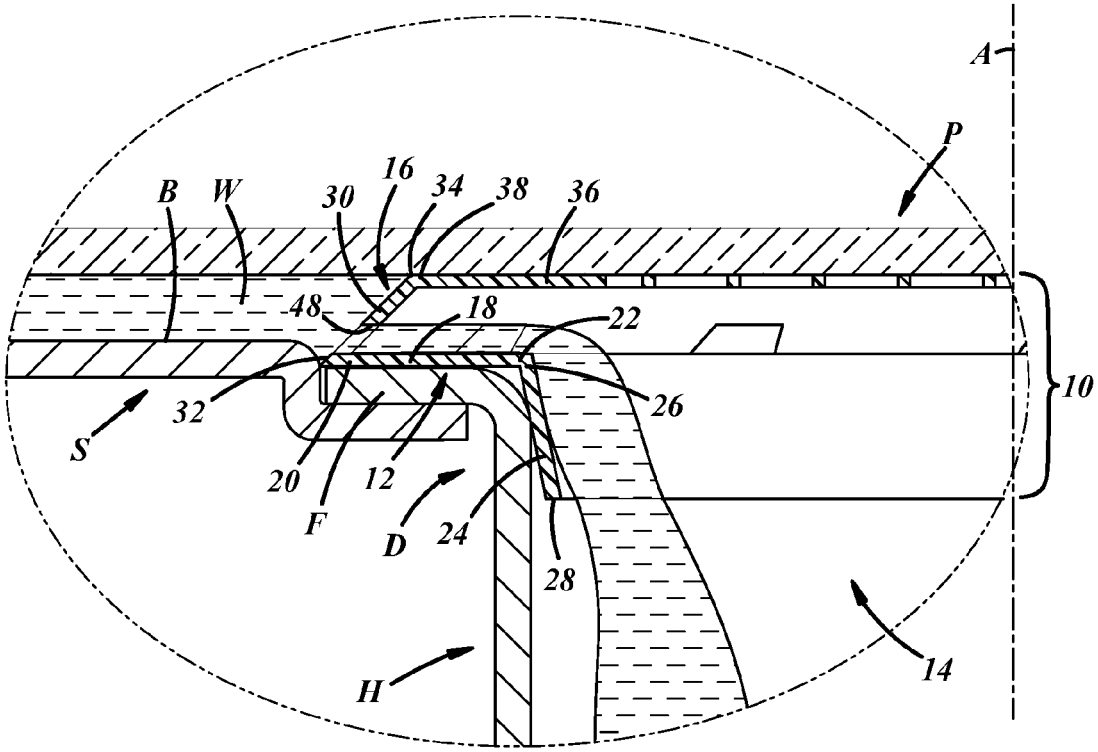
FIG. 2 is an enlarged, fragmentary, sectional view taken from ellipse 2 of FIG. 1.

Referring specifically to the drawings, FIGS. 1 and 2 show an illustrative embodiment of a pedestal strainer 10, which may be used to cover a drain D of a sink S. The strainer 10 has a perforate upper surface that is spaced above a bottom B of the sink S and can prevent an object P laid over the drain D from creating a seal with the sink bottom B around the drain D. Accordingly, water W will not back up in the sink S and, instead, flows through a perforate sidewall of the strainer 10 and down the drain D. Also, the strainer 10 is not easily clogged with debris, so that the water W will not tend to back up in the sink S.

With reference to FIG. 2, the strainer 10 generally may include a central longitudinal axis A, a base 12 extending transversely with respect to the axis A, and a drain coupling 14 extending downwardly from the base 12 to couple the strainer 10 to the drain D and/or center the strainer 10 with respect to the drain D. The strainer 10 also includes a perforate pedestal 16 that may extend upwardly from the base 12 to strain the water W as it flows therethrough down the drain D and to support the object P, which may be a pan, pot, bakeware, or the like. The strainer 10 need not include central shafts, shanks, support pins, or the like for support.

The illustrated wall thicknesses of the various portions of the strainer 10 present just one example. The walls may be thinner or thicker than that shown, and the wall thicknesses may vary from one portion of the strainer 10 to another. Those of ordinary skill in the art will recognize that the wall thicknesses are application-specific and depend on the load requirements, material(s) used, and the like.

The base 12 may be flat and may include a body 18 having a radially outer periphery or periphery 20 and a radially inner periphery 22. The body 18 may include a planar annulus extending complete circumferentially around the axis A, as shown in the illustrated embodiment. But, in other embodiments, the body 18 may be spoked, webbed, or of any other suitable configuration. The base 12 may be composed of a polymeric material and, preferably, may be composed of an elastomeric material. The phrase "polymeric material" generally includes relatively high-molecular-weight materials of either synthetic or natural origin and may include thermosets, thermoplastics, and/or elastomers. The term "elastomeric" generally includes a material, which at room temperature, may be stretched under low stress to about twice its original length or more and, upon release of the stress, will return with force to its approximate original length. Elastomeric also encompasses any of various elastic substances that may be rubber-like.

The drain coupling 14 may include a tubular coupling sidewall 24 having an upper end 26 coupled to the base 18, extending downwardly from the base 18, and terminating in an open lower end 28. The tubular coupling sidewall 24 may be frustoconical. For example, the upper end 26 may have a radially outer periphery substantially equal to or smaller than the radially outer periphery 20 of the base 18 and, likewise, the lower end 28 may have a radially inner periphery smaller than that of the upper end 26. Accordingly, the sidewall 24 may extend axially downwardly from the base 12 at an obtuse angle with respect to the base 12. Also, the sidewall 24 may be straight. The base 12 and the drain coupling 14 may be of unitary construction, as shown in the illustrated embodiment, but may be of separate construction and assembled, fused, fastened, or otherwise coupled together in any suitable manner. Accordingly, like the base 12, the drain coupling 14 may be composed of a polymeric material, preferably and elastomeric material.

The pedestal 16 includes a sidewall 30 extending axially or upwardly from a lower end 32 and terminating at an upper end 34. The lower end may establish a radially outer periphery of the pedestal 16 and the upper end 34 may establish a height of the pedestal 16 from the lower end 32. The lower end 32 may be coupled to the base 12. The pedestal 16 may be frustoconical. For example, the lower end 32 may have a radially outer periphery that is substantially the same as or greater than the outer periphery 20 of the base 12, and the upper end 34 may have a radially inner periphery that is smaller than that of the lower end 32. Accordingly, the sidewall 30 may extend axially upwardly at an acute angle with respect to the base 12. Also, the sidewall 30 may be straight. The lower end 32 of the sidewall 30 may be supported by the sink bottom B and/or a flange F of a strainer housing H at a seam between the sink bottom B and a radially outer edge of the flange F. The strainer 10 may be configured to be interference fit to the sink/flange seam, wherein the radially outer periphery of the strainer 10 is configured for an interference fit (e.g., a snap fit) with a corresponding radially inner periphery of the sink/flange seam.

The pedestal 16 further includes a transverse upper wall 36 that is coupled to the sidewall 30 at a radially outer periphery 38 of the upper wall 36, and that extends radially inwardly therefrom. Accordingly, the sidewall 30 may be disposed at an angle that is obtuse with respect to the upper wall 36. The upper wall 36 may be flat and may extend in a direction perpendicular to the axis A.

Figure 3:
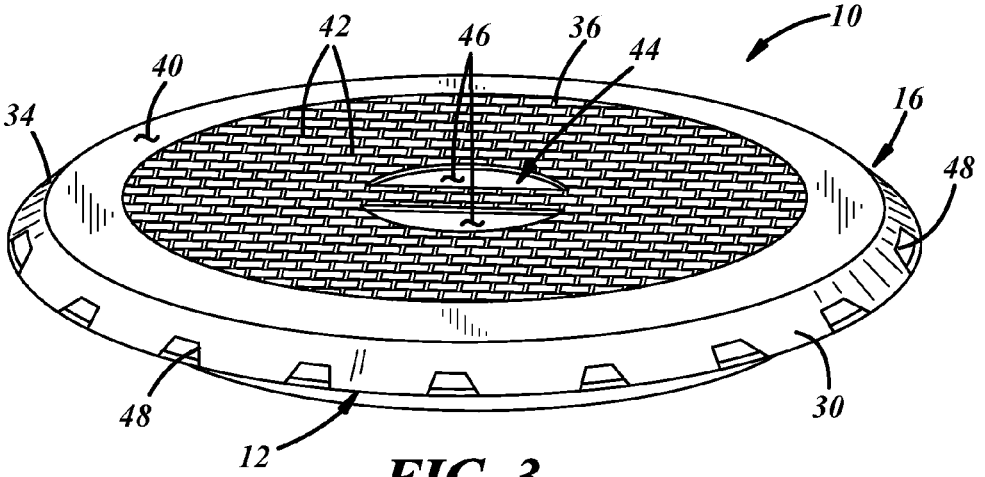
FIG. 3 is an enlarged perspective view of the strainer of FIG. 1.
Figure 4:
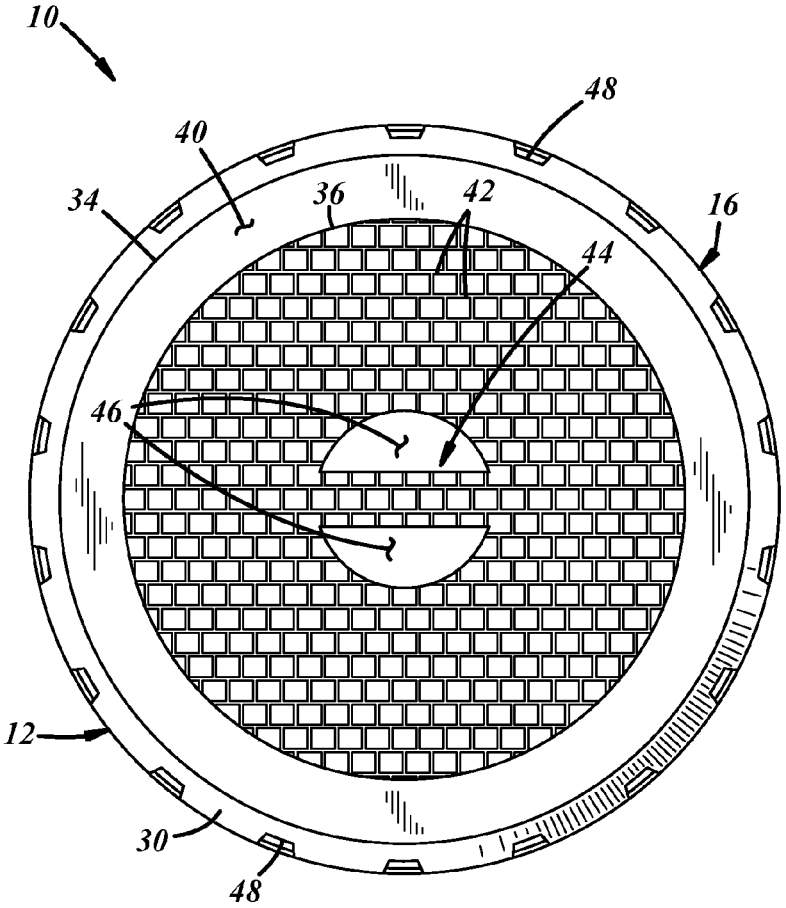
FIG. 4 is an enlarged top view of the strainer of FIG. 1.

With reference to FIGS. 3 and 4, the upper wall 36 may be perforate. As used herein, the term "perforate" includes structure having holes, spaces, pores, interstices, or any other water permeable structure. In the illustrated embodiment, the upper wall 36 includes an imperforate margin or rim 40 that may extend radially inwardly from the upper end 34 of the sidewall 30 and may be circumferentially continuous. The upper wall 36 also may include a perforate web 42 extending radially inwardly from the rim 40. In other embodiments, the upper wall 36 may be composed entirely of the perforate web 42. The perforate web 42 may include a screen, lattice, or mesh as exemplified by the figures, or, in other embodiments, the perforate web 42 may include expanded metal sheet, a hub and spoke arrangement, or any other suitable web structure with holes, apertures, or spaces therein to allow water to pass therethrough.

The upper wall 36 also may include a handle 44. In the illustrated embodiment, the handle 44 may be an integral portion of the web 42 and may be established by apertures 46 on either side of the portion of the web 42 that constitutes the handle 44. The apertures 46 may include areas where material of the web 42 was removed, or may be depressions formed in the web 42.

With reference to FIGS. 3-7, the sidewall 30 may be perforate to facilitate flow of water toward the inner periphery 22 of the base 12. For example, as shown in the illustrated embodiment, the sidewall 30 may include a circumferential array of apertures 48 extending radially therethrough, and the sidewall 30 otherwise may be imperforate. The apertures 48 may be open at the base 12 and may extend upwardly along the sidewall 30 but terminate in ends short of the upper wall 36. The apertures 48 may be wider at their open ends at the base 12 and narrower at their closed ends. The apertures 48 may be eighteen in number as exemplified in the figures, or may be of any other suitable quantity. The apertures 48 are shown as being trapezoidal in shape when viewed from a direction perpendicular to an outer surface of the sidewall 30, but may be semi-circular, parabolic, or of any other suitable shape. The apertures 48 provide a flow path through the strainer 10 when a pan, pot, dish, or other object is laid across the top of, and supported by, the pedestal 16. In other embodiments, the sidewall 30 may include a screen, lattice, mesh, or the like, or any other suitable perforate wall.

The base 12 and the pedestal 16 may be of unitary construction, as shown in the illustrated embodiment, but may be of separate construction and assembled, fused, fastened, or otherwise coupled together in any suitable manner. Accordingly, like the base 12, the pedestal 16 may be composed of a polymeric material, preferably an elastomeric material.

Figure 5:
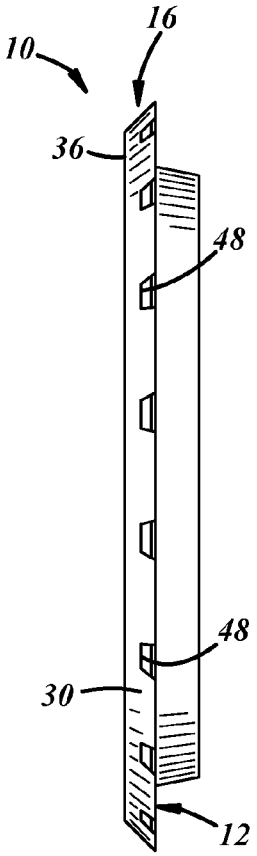
FIG. 5 is an enlarged side view of the strainer of FIG. 1.
Figure 6:
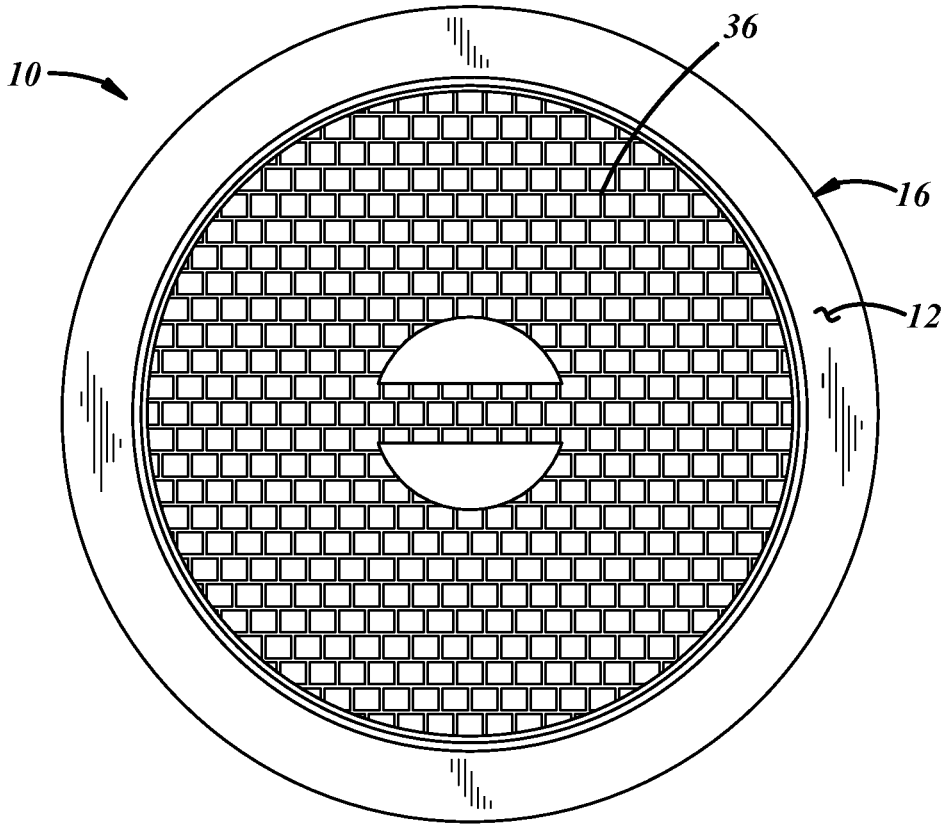
FIG. 6 is an enlarged bottom view of the strainer of FIG. 1.
Figure 7:
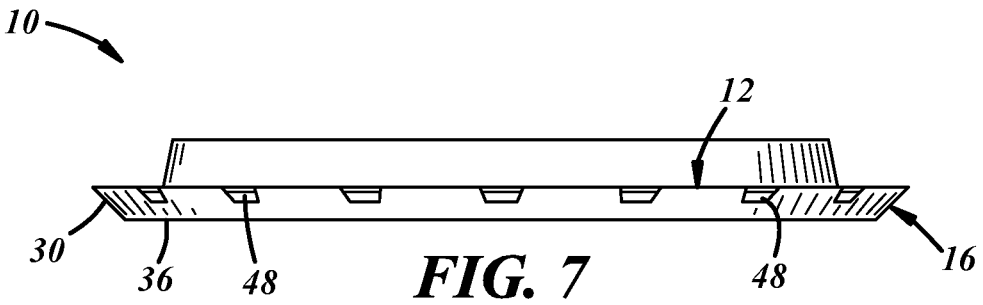
FIG. 7 is an enlarged view of another side of the strainer of FIG. 1.

With reference to FIGS. 4 and 5, the pedestal 16 may have a relatively low profile and a relatively high aspect ratio. The aspect ratio of the pedestal 16 is the relationship between the radially outer periphery of the pedestal 16 with respect to the profile or height of the pedestal 16. The aspect ratio of the pedestal 16 as exemplified in the drawings is about 25 (plus or minus 10%), but may be between 20 and 30, including all subranges therebetween.

Figure 8:
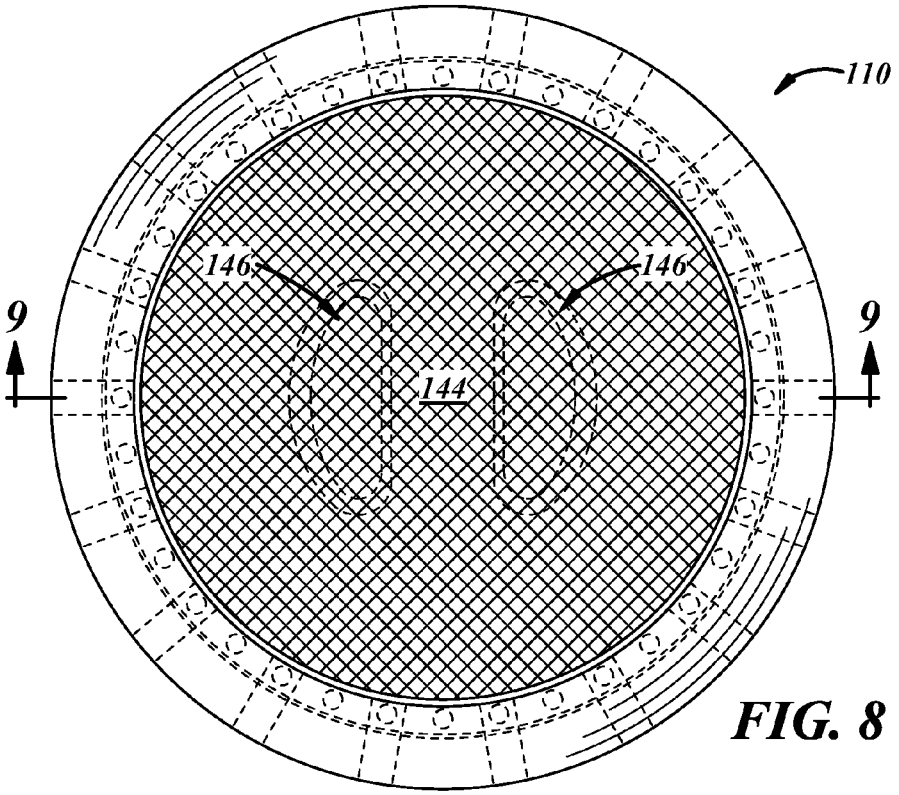
FIG. 8 is a top view according to another illustrative embodiment of a pedestal strainer.
Figure 9:
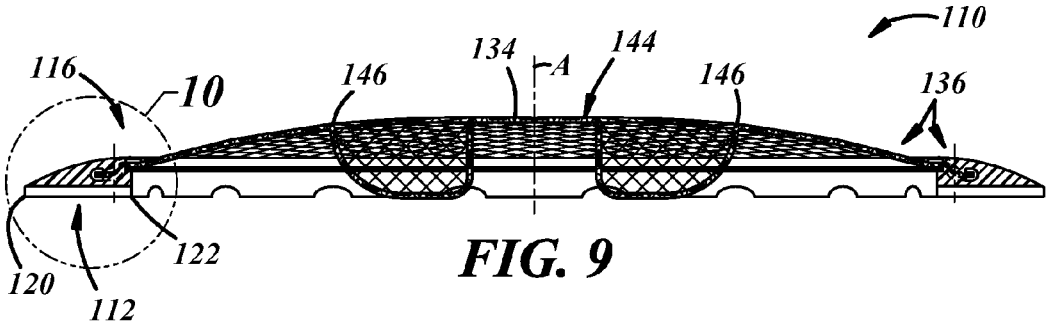
FIG. 9 is an enlarged, cross-sectional view of the strainer of FIG. 8, taken along line 9-9 thereof.
Figure 10:
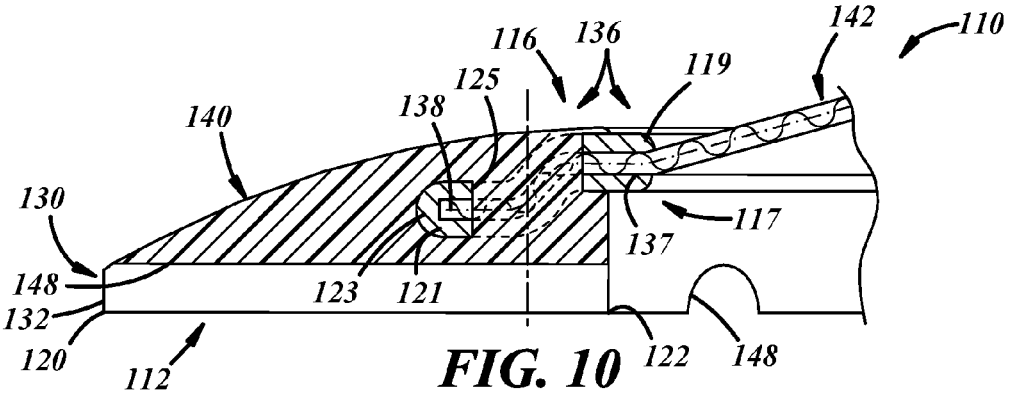
FIG. 10 is an enlarged, fragmentary, sectional view of the strainer of FIG. 8, taken from circle 10 of FIG. 9.

FIGS. 8-10 illustrate another illustrative embodiment of a strainer 110. This embodiment is similar in many respects to the embodiment of FIGS. 1-9 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

With reference to FIG. 9, the strainer 110 generally may include a central longitudinal axis A, a base 112 extending transversely with respect to the axis A, and a pedestal 116 that may extend upwardly from the base 112. The base 112 may include a lower surface of a ring or annular rim 140, and the base 112 may include a radially outer periphery 120 and a radially inner periphery 122.

With reference to FIG. 10, the pedestal 116 may include other portions of the rim 140 and a perforate disc or web 142 that may be disposed radially inwardly of, and coupled to, the rim 140. For instance, the web 142 may be embedded in the rim 140, for example, by overmolding the rim 140 to the web 142. The pedestal 116 includes a transverse upper wall 136 that extends radially inwardly from the sidewall 130 and may include a portion of the rim 140 and the perforate web 142. The rim 140 may be composed of a polymeric material, for instance, plastic, and, more specifically, polyethylene, and the web 142 may be composed of a metallic material, for instance, stainless steel.

A retainer 117 may be used to retain the web 142 to the rim 140. The retainer 117 may include an annular component having upper and lower flanges 119, 121 for trapping a radially outer margin 137 of the web 142 therebetween. The retainer 117 also may include an outer rim 123 connecting the flanges 119, 121 and adjacent to the radially outer periphery 138 of the wall 136. Thus, the retainer 117 may have a closed radially outer periphery and an open radially inner periphery. The flanges 119, 121 and the outer margin 137 of the web 142 may be stepped as illustrated for good retention to the rim 140 and for good rigidity. For example, the stepped portion may include a radially outer lower level and a radially inner upper level. Also, the retainer 117 may include one or more apertures 125 that may extend axially through the flanges 119, 121, and that may be provided in a circumferential array (as shown in FIG. 8). In an embodiment where the rim 140 is overmolded to the retainer 117 and to the web 142, the apertures 125 facilitate flow of rim material therethrough to interlock the retainer 117 and the web 142 to the rim 140.

With respect to FIGS. 8 and 9, the upper wall 136 may include an annular excurvate portion extending in a direction transverse with respect to the axis A and a central flat portion that may extend in a direction perpendicular to the axis A. The upper wall 136 also may include a handle 144. In the illustrated embodiment, the handle 144 may be an integral portion of the web 142 and may be established by apertures 146 on either side of the portion of the web 142 that constitutes the handle 144. The apertures 146 may include depressions formed in the web 142.

With respect to FIG. 10, the pedestal 116 also includes a sidewall 130 extending from a lower end 132 and terminating at an upper end 134. The sidewall 130 may be perforate. For example, as shown in the illustrated embodiment, the sidewall 130 may include one or more apertures 148 extending radially therethrough, and that may intersect the base 112. The apertures 148 may be provided in a circumferential array (as illustrated in FIG. 8). The sidewall 130 otherwise may be imperforate. As illustrated in FIG. 9, the apertures 148 are shown as being generally semi-circular in shape when viewed from a direction perpendicular to an outer surface of the sidewall 130, but may be of any other suitable shape. In any case, the apertures 148 provide a flow path through the strainer 110 when a pan, pot, dish, or other object is laid across the top of, and supported by, the pedestal 116.

The pedestal 116 may have a relatively low profile and a relatively high aspect ratio. The aspect ratio of the pedestal 116 as exemplified in FIG. 9 is about 12.5 (plus or minus 10%), but may be between 10 and 15, including all subranges therebetween. Accordingly, the aspect ratio of a pedestal in accordance with all embodiments may be between 10 and 30, including all subranges therebetween.

In general, the strainers 10, 110 can be manufactured according to techniques known to those skilled in the art, including molding, machining, stamping, casting, and/or the like. In one embodiment, each of the strainers 10, 110 may be constructed of a single, unitary component, particularly if each of the strainers 10, 110 is composed of an elastomeric material. In another embodiment, each of the strainers 10, 110 may include two separate components that are coupled together, such that each of the strainers 10, 110 may be a two-piece article of manufacture. In a further embodiment, each of the strainers 10, 110 may include three separate components that are coupled together, such that each of the strainers 10, 110 may be a three-piece article of manufacture. In the embodiment wherein each of the strainers 10, 110 is a multi-piece article of manufacture, any suitable portion thereof may be welded, brazed, fastened, adhered, integrally engaged or interengaged, or coupled in any other suitable manner to any other suitable portion. Likewise, any suitable materials can be used in making each of the strainers 10, 110, such as metals, composites, polymeric materials, and/or the like.

Some aspects of the configuration of the strainers 10, 110 are significant in that they enable a solution to a problem not even addressed in the prior art of sink drain strainers. Surprisingly, in ordinary use, the presently disclosed strainers 10, 110 are capable of supporting relatively heavy loads (e.g., pans, pots, bakeware, etc.) without failure, while allowing water to flow therethrough. Accordingly, the presently disclosed strainers 10, 110 provide a simple but effective solution to an everyday, common household problem. It is believed that the presently disclosed strainers 10, 110 present a new form factor for drain strainers: a simple, low-profile, high-aspect ratio, pedestal-style strainer. The strainers 10, 110 need not include separately attached handles, fasteners, baskets, plugs, and other complexities of prior art drain strainers.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A sink drain pedestal strainer with a central longitudinal axis, and comprising:
- an annular base; and
- a pedestal extending upwardly away from the base, and including:
  - a perforate sidewall, and
  - a perforate upper wall extending radially inwardly from the sidewall, and including a flat perforate web.

2. The strainer of claim 1, further comprising:
- a drain coupling including a tubular coupling sidewall extending downwardly from the base and terminating in an open lower end, and having a coupling diameter smaller than a radially outer periphery of the base.

3. The strainer of claim 1, wherein the perforate sidewall includes a circumferential array of apertures extending radially through the sidewall, which is otherwise imperforate.

4. The strainer of claim 3, wherein the apertures are open at the base and extend upwardly along the sidewall but terminate short of the upper wall in the form of closed ends.

5. The strainer of claim 4, wherein the apertures are wider at the base and are narrower at the closed ends.

6. The strainer of claim 1, wherein the pedestal is frustoconical, such that the sidewall is disposed at an acute angle with respect to the base and at an obtuse angle with respect to the upper wall.

7. The strainer of claim 1, wherein the upper wall includes an imperforate rim, and a perforate web extending radially inwardly from the rim.

8. A sink drain pedestal strainer with a central longitudinal axis, and comprising:

an annular base; and a pedestal extending upwardly away from the base, and including:

a perforate sidewall, and a perforate upper wall extending radially inwardly from the sidewall, wherein the upper wall includes a perforate web including an integral handle.

9. A sink drain pedestal strainer with a central longitudinal axis, and comprising:

an annular base; and a pedestal extending upwardly away from the base, and including:

a perforate sidewall, and a perorate upper wall extending radially inwardly from the sidewall, with an aspect ratio between a radially outer periphery of the pedestal and a height of the pedestal of between 10 and 30.

10. The strainer of claim 9, wherein the pedestal is frustoconical and the aspect ratio is between 20 and 30, wherein the sidewall is straight, has a circumferential array of apertures therein but is otherwise imperforate, has a lower end establishing a radially outer periphery of the pedestal, extends axially and radially inwardly from the lower end, and terminates at an upper end establishing a height of the pedestal from the lower end, and wherein the upper wall is planar and includes an imperforate rim extending radially inwardly from the upper end of the sidewall and a perforate web extending radially inwardly from the rim.

11. The strainer of claim 10, further comprising:

a drain coupling extending downwardly from the base, and including a tubular coupling sidewall having an upper end coupled to the base with a coupling diameter smaller than a radially outer periphery of the base, extending downwardly from the base at an obtuse angle with respect to the base, and terminating in an open lower end.

12. The strainer of claim 1, wherein the strainer is unitary and composed of a elastomeric material.

13. The strainer of claim 1, wherein the pedestal includes a polymeric rim overmolded to a metallic perforate web.

14. The strainer of claim 13, further comprising an annular retainer disposed between the rim and the web.

15. The strainer of claim 14, wherein the retainer includes upper and lower flanges to trap a marginal portion of the web therebetween.

16. The strainer of claim 15, wherein the retainer also includes a plurality of apertures extending axially through the flanges in a circumferential array, and through which portions of the rim extend.

17. The strainer of claim 13, wherein the retainer is stepped to include a radially outer lower level and a radially inner upper level.

18. A sink, comprising:

a bottom having a drain opening therethrough;

a strainer housing disposed in the drain opening of the bottom and having a mounting flange carried by the bottom around the drain opening; and the pedestal strainer of claim 1, wherein the lower end of the pedestal locates at a seam between the sink bottom and the flange.

19. The sink of claim 18, wherein the pedestal strainer has an upper surface spaced above the bottom of the sink when the lower end of the pedestal strainer is located at the seam.

20. The sink of claim 19, wherein the pedestal strainer is interference fit to the sink bottom.

* * * * *